United States Patent [19]

Bean

[11] Patent Number: 4,475,834

[45] Date of Patent: Oct. 9, 1984

[54] WRITING INSTRUMENT PROJECTABLE BY FLUID PRESSURE

[76] Inventor: Donald F. Bean, Tienda Fanci, Calle Skal 9-10, Torremolinos, Malaga, Spain

[21] Appl. No.: 364,880

[22] Filed: Apr. 2, 1982

[51] Int. Cl.[3] ..... B43K 21/02; B43K 24/00

[52] U.S. Cl. ..... 401/99; 401/55; 401/101; 401/65

[58] Field of Search ..... 401/99, 65, 67, 101, 401/153, 55, 93, 92

[56] References Cited

U.S. PATENT DOCUMENTS

| | | | |
|---|---|---|---|
| 3,285,228 | 11/1966 | Fisher | 401/101 |
| 3,576,374 | 4/1971 | Lile | 401/52 |
| 3,883,253 | 5/1975 | Naruse et al. | 401/92 X |
| 4,270,870 | 6/1981 | Hashimoto et al. | 401/93 |
| 4,358,210 | 11/1982 | Hashimoto et al. | 401/67 X |

FOREIGN PATENT DOCUMENTS

| | | | |
|---|---|---|---|
| 1020256 | 11/1957 | Fed. Rep. of Germany | 401/65 |
| 1942979 | 3/1971 | Fed. Rep. of Germany | 401/99 |
| 2656346 | 8/1977 | Fed. Rep. of Germany | 401/99 |
| 1307934 | 9/1962 | France | 401/99 |
| 1558280 | 2/1969 | France | 401/101 |

*Primary Examiner*—Steven A. Bratlie

*Attorney, Agent, or Firm*—Beall Law Offices

[57] ABSTRACT

Projecting mechanisms for writing elements are actuated by applying pressure to the external casing of the instrument. The writing element is not latched in an exposed condition, therefore the writing element is only exposed when pressure is applied to the casing, as is done when writing with a pen. The projecting mechanism allows for projecting the writing element by applying pressure at substantially any circumferential point along the casing of the pen, or in one embodiment only along the longitudinal portion of the pen closest to the writing end.

7 Claims, 8 Drawing Figures

WRITING INSTRUMENT PROJECTABLE BY FLUID PRESSURE

BACKGROUND OF THE INVENTION

1. Field of the Invention

The present invention relates to writing instruments, particularly ball point pens and projecting mechanisms for the writing element.

2. Description of the Prior Art

A problem encountered in the use of ball point pens is that the pens, generally stored in the shirt or coat pocket of the user, tend to mark the coat or pocket when the user stores the pen without retracting the tip of the writting element. In an attempt to solve this problem, pen constructions have been devised to prevent the user from inadvertently storing a pen when the tip of the writing element is exposed.

One such construction is shown in U.S. Pat. No. 2,881,736 issued to N. Zepelovitch. Zepelovitch shows a construction in which the writing element tip is exposed by depressing a rockable clip which is part of the pen casing. A user of the Zepelovitch pen would not be able to store a pen using the clip when the tip of the writing element is exposed.

In another attempt to prevent the inadvertent marking of shirts and coats by a user attempting to store a pen while having the tip of the writing element exposed, Dannebaum in U.S. Pat. No. 3,181,507 shows an automatic retracting pen tip. Dannebaum introduces however, an actuater for projecting the writing element tip which is mechanically complex and therefore impractical for production of such pens on a large scale.

SUMMARY OF THE INVENTION

It is an object of the present invention to overcome the aforementioned problems with writing instruments, and with particularly ball point pens. The tip of the writing element in the pen of the present invention is projected only when the user of the pen is applying pressure about the exterior of the casing, such as is done when a user is writing with the instrument.

Another object of the invention to overcome the prior art disadvantages of pens which are not suitable for economical mass production. The instrument of the present invention has a construction which is practical for mass production in that the mechanisms for projecting the writing element tip are mechanically simple, easily produced and quickly and easily assembled.

It is a further object of this invention to provide a construction for a writing instrument can be that produced by introducing small changes in the equipment used to produce commercially available pens.

DETAILED DESCRIPTION OF THE DRAWINGS

Figure 1:
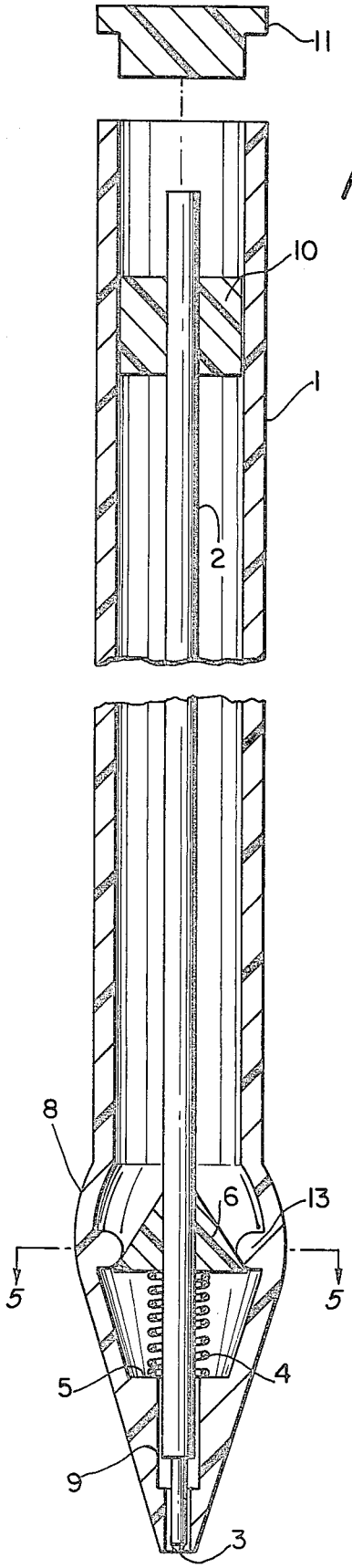
FIG. 1 is a longitudinal cross section of the pen constructed according to this invention.

In the drawings a generally tubular outer casing 1 is shown having disposed longitudinally therein a writing element 2 of the type generally known in the art. Element 2 is provided with writing element tip 3 which can be of a type well known in the ball point art. In this case, writing element 2 would be a tubular ink reservoir. As part of the projecting mechanism, a conical cam 6 is attached to element 2. Coiled about element 2 between cam 6 and an inner annular shoulder 5 is coil spring 4. In the embodiment of the pen shown in FIG. 3, and enlargement 7 on element 2 is sufficient to provide an upper stop surface for coil spring 4.

Figure 6:
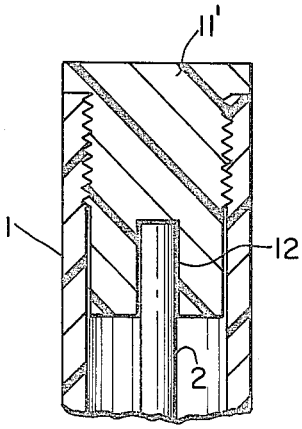
FIG. 6 is a longitudinal cross section of the pen shown in FIG. 1 further showing another embodiment of the cap shown in FIG. 1.

The casing 1 is constructed of a generally resilient plastic such as polypropylene or rubber material which deforms under the pressure created by the normal force exerted between the thumb and fingers of a user when a user is writing with the pen. In FIG. 1, a bulged portion 8 of casing 1 is shown. The bulged portion is integral with casing 1 but may have a thinner wall thickness than the wall thickness of casing 1 such that the bulged portion 8 is more easily deformable than the other portions of the pen casing. Shoulder 5 is the top part of a smaller diameter portion 9 of casing 1. The diameter of portion 9 is only large enough to slideably receive one end of element 2 at the writing end of the pen. This supports longitudinal movement of element 2 within casing 1 associated with projecting and retracting the element during use of the pen and nonuse of the pen respectively. Supporting element 2 at the other end of the pen is a spacer 10 attached to the element 2 to center it within casing 1. The spacer 10 would be dimensioned to allow for sliding between spacer 10 and the interior of casing 1. In the one embodiment as shown in FIG. 1, the cap 11 does not interfere with the longitudinal movement of element 2. In the embodiment of FIG. 6 however, a spacer is not necessary because cap 11′ has an extended portion containing a bore 12 which receives the non-writing end of element 2 much in the same way the writing end of element 2 is received within smaller diameter portion 9. The cap for all embodiments can be a threaded end closure for casing 1 like cap 11′ or can be constructed for fitting within casing 1 as a plug like cap 11.

Figure 2:
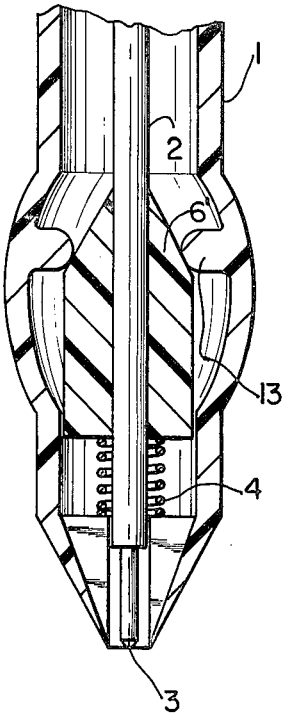
FIG. 2 is a longitudinal section of the lower half of the pen shown in FIG. 1 further showing a modification of the cam and casing construction.

In the embodiment shown in FIG. 2 a cam 6′ can have and extended base portion 13 to engage with the inner surface of casing 1 for slideably supporting the writing end of element 2 in longitudinal movement.

Figure 5:
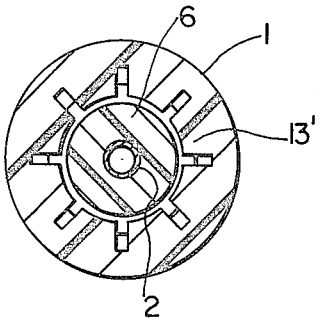
FIG. 5 shows a cross section which is taken along the line 5—5 of FIG. 1.
Figure 4:
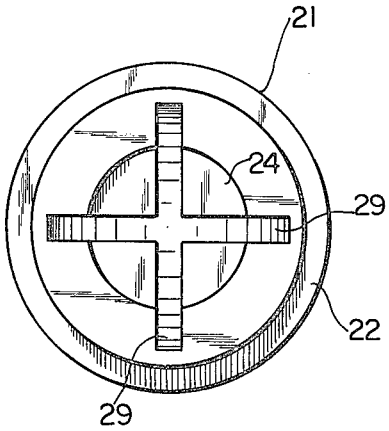
FIG. 4 is a top view of the cap shown in FIG. 3.

To project writing element tip 3 outwardly from casing 1 an actuating ring 13 is provided integral with bulged portion 8. The location of bulged portion 8 is generally within the first one third or one fourth portion of the casing from the writing end. The position of the ring 13 with respect to the writing end of the casing 1 is within one half to three inches from the end. Similarly for a smaller than standard sized pen the position of the ring on casing 1 would be between 0.1 times the length of the casing and 0.4 times the length of the casing from the writing end of casing 1. The bulged portion 8 is flexible enough to be deformed under the normal force exerted between the thumb and forefingers of the hand of a user when the user is writing with the pen. The ring 13 can be solid as shown in FIG. 1 or, as shown in FIG. 5, an annularly segmented ring 13' can be used. When pressure is applied by the user at subtantially any point about the circumference of the casing the ring 13 moves inwardly riding up on the surface of cam 6 causing element 2 and therefore tip 3 to project outwardly from casing 1. Because the ring 13 extends continuously about the inner circumference of bulged portion 8, the user does not have to look or feel for a particular mechanism associated only with one circumferential section of casing 1.

In operation once a user has found the bulged portion he merely needs to squeeze the casing at that portion to project and expose the writing tip 3.

Figure 3:
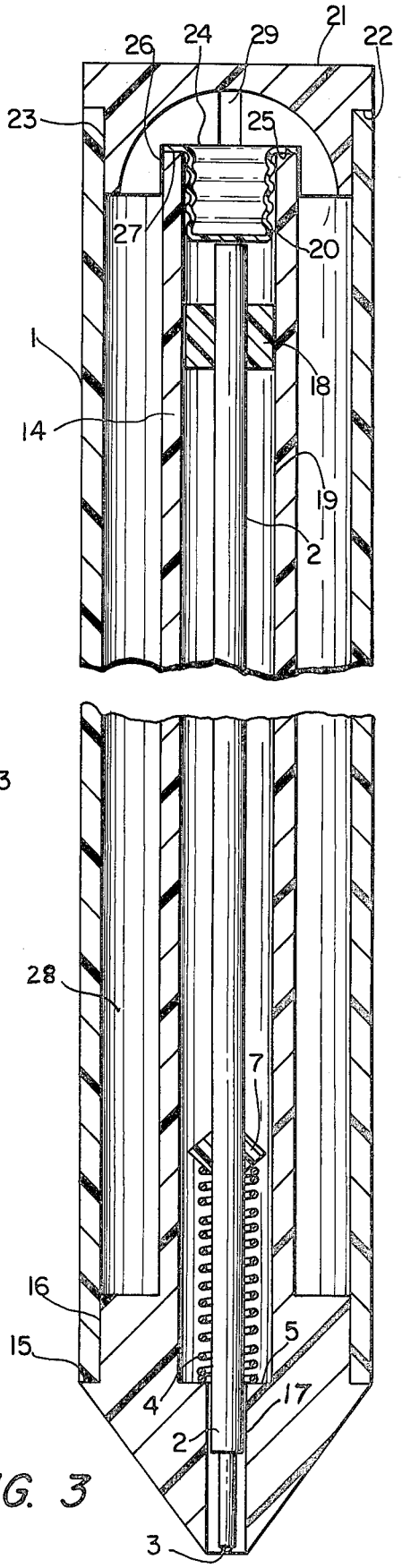
FIG. 3 is a longitudinal cross section showing a second embodiment of the pen constructed according to this invention.

In FIG. 3 a second embodiment of the pen is shown. In addition to casing 1 is an inner casing 14 constructed of a hard substantially non deformable plastic or metal. The inner casing 14 has, in addition to an inner annular shoulder 5 for supporting one end of coiled spring 4, and external annular shoulder 15 and seating surface 16 associated therewith for receiving in a plug-type fashion the writing end of casing 1. Within inner casing 14 is a small diameter bore 17 similar to portion 9 of casing 1 of the pen embodied in FIG. 1 for receiving element 2 in sliding and guiding engagement therewith. A similar spacer 18 is provided attached to element 2 for spacing element 2 centrally and guiding element 2 for longitudinal sliding movement within the larger bore 19 of inner casing 14.

Acting to enclose the end opposite the writing end of inner casing 14 is an expansible chamber device 20 shown in FIG. 3 as a corrugated bellows. A piston acting within bore 19 would also be a suitable expansible chamber device providing for the projecting of element 2 as will be described. A cap 21 has an external annular shoulder 22 and seating surface 23 associated therewith for receiving the other end of casing 1 in the same plug-type fashion as was described for the writing end of casing 1. Cap 21 has an internal cylindrical blind bore 24 having a shoulder 25, bore 24 being dimensioned to receive inner casing 14 with close tolerances between bore wall 26 and the exterior of inner casing 14. Sandwiched between shoulder 25 and the top circumferential edge 27 of casing 14 is the open end of expansible chamber device 20. In the case where a piston might be used in place of a bellows a suitable seal would be disposed between edge 27 and shoulder 25.

Figure 7:
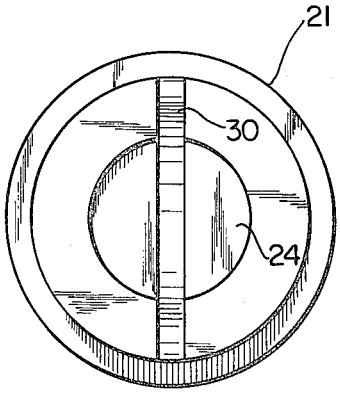
FIG. 7 is a view of another embodiment of the cap shown in FIG. 4.
Figure 8:
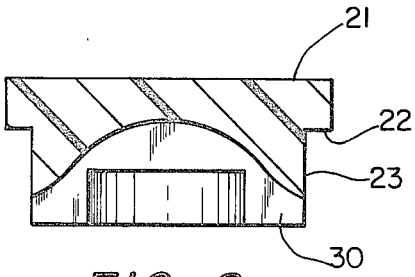
FIG. 8 is a side sectional view of the cap shown in FIG. 7.

Between outer casing 1 and inner casing 14, a reservoir 28 is formed that is sealed at the writing end and cap end of the pen as has been herein described. In FIG. 3, cap 21 is shown having two arcuate open portions 29 extending upwardly from the bottom of cap 21 but not extending radially outward to seating surface 23 of cap 21. The arcuate open portions 29 provide for a fluid communication channel between reservoir 28 and expansible chamber device 20. A modified cap 21' is shown in FIG. 7 in which there is only one arcuate open portion 30 that extends upwardly from the bottom of cap 21. Portion 30 is shown extending radially, outward to seating surface 23 providing small open portion along seating surface 23. This also provides for a suitable seal between casing 1 and cap 21. FIG. 8 is a cross sectional side view of cap 21' showing how one arcuate portion 30 could extend through to seating portion 23.

In practice a fluid such as water or air would be disposed within reservoir 28. The reservoir would be sealed as aforementioned such that the fluid would not leak.

To project writing element 2 and thereby expose element tip 3, one would apply pressure substantially at any longitudinal portion of casing 1 thereby creating a increased pressure of the fluid in the reservoir 28. Preferably however, the pen is constructed such that only the lower one-fourth or one-third of the longitudinal portion of the casing near the writing end would be deformable. Thus an increase in pressure of the fluid only occurs when one applies pressure along the lower portion of casing 1. The upper three-fourths or two-thirds of the casing can be rendered substantially non-deformable by the application of an outer rigid plastic or metal sleeve having an internal diameter equal to the external diameter of casing 1. Similarly of course, an internal rigid plastic or metal sleeve can be inserted within casing 1 having an external diameter equal to the internal diameter of casing 1. In either case the sleeve extends along the upper portion of the pen which is generally not grasped between the thumb and forefingers when one is writing with the pen. An outer upper sleeve portion may also include a clip for attaching the pen to a pocket in the conventional manner as is standard in the art for pens.

The casing is not stretchable and therefore applying pressure to the casing results in deforming a longituidinal portion of the casing from a substantially circular cross-sectional area to a generally eliptical cross-sectional area. This change in the cross-sectional configuration of the casing when one is applying pressure to the casing results in a reduction in the volume of the reservoir and thereby an increase in the volume of the expansible chamber device 20 corresponding to the decrease in volume of the reservoir 28. Preferably the spring 4 is designed to exert a retracting force on writing element 2 only slightly larger than the projecting force exerted on writing element 2 created by applying pressure to casing 1 as herein described. It will also be understood that expansible chamber device 20 will readily expand in the longitudinal direction as a result on the increase in pressure of the fluid in the reservoir. The increase being created when the volume of the reservoir is subtantially reduced by the action of the user deforming a longitudinal portion of the casing 1 as is done when one writes with the pen.

It is further understood that coil spring 4 urges writing element 2 to be positively engaged with expansible chamber device 20 such that when chamber device 20 expands due to the increased pressure of the fluid, writing tip 3 projects outwardly and is thereby exposed. The increase in pressure of the fluid in reservoir 28, created by the thumb and forefingers of the users hand, decreases when the user discontinues writing with the pen as in the normal handling of the pen. This results in a decrease in the pressure of the fluid in reservoir 28 further causing writing element tip 3 to retract due to the action of spring 4. The writing element 2 is not locked or latched when in the projected or exposed position and therefore the tip 3 of the pen is exposed only when the user is writing. This protects the user from inadvertently soiling his clothing by preventing the user from storing the pen when the writing element tip 3 is exposed.

Obviously, many modifications and variations of the present invention are possible in light of the above teachings and overcoming the prior art problems as described. Thus, it is to be understood that, within the scope of the appended claims, the invention may be practice otherwise than as specifically described and illustrated with references to the preferred embodiments.

I claim:

1. A pen having longitudinally opposed first and second ends, comprising:

a writing element comprising a longitudinal tube having ink therein and longitudinally opposed ends, one of said ends being a writing tip;

actuating means for producing a projecting force in response to lateral pressure applied at any point about the entire outer periphery of said pen between said longitudinally opposed ends and for enabling a pen user to write with said pen when said pen is grasped and positioned in the hand of a user in the normal manner for the intended purpose of writing with said pen;

said actuating means comprising:

a generally tubular outer pen casing having a resilience such that said outer casing is substantially deformed with the normal amount of force created between the fingers and thumb of a pen user when the user is writing with said pen;

a generally tubular inner rigid casing having opposed ends;

a fluid reservoir, said reservoir being located substantially between said outer casing and said inner casing and having longitudinally opposed means for sealing said reservoir; and a fluid contained in said reservoir;

said writing element being disposed longitudinally within said inner casing with said writing tip adjacent said first end and supported for longitudinal sliding movement;

biasing means coacting with said inner casing and said writing element for biasing said writing element longitudinally in a direction toward said second end;

projecting means responsive solely to said projecting force produced by said actuating means for projecting said writing tip longitudinally against said biasing means in a direction toward said first end to project said writing tip longitudinally outwardly from said first end a distance sufficient to expose said writing tip, said projecting means comprising expansible chamber means disposed within one of said ends of said inner casing near said second end in fluid communication with said reservoir such that when said projecting force is produced the volume of said fluid in said reservoir is reduced and said fluid is caused to expand said expansible chamber means toward said first end to thereby expose said writing tip, said writing element being positively engaged with said expansible chamber means by said biasing means.

2. The pen according to claim 1, further including:

said inner casing having an external annular integral seating surface and shoulder at one of said ends disposed near said first end adapted for receiving said outer casing and for sealing said outer casing to said inner casing;

said inner casing having a circumferential edge at the other of said ends;

a cap at said second end fitted to space said inner casing and said outer casing concentrically apart;

said cap providing means for sealing said expansible chamber means against said inner casing at said one end and further providing fluid passage means for enabling said fluid in said fluid reservoir to communicate with said expansible chamber means.

3. The pen according to claim 2 wherein said cap further comprises:

an external annular shoulder and annular seating surface for receiving said outer casing;

an internal, cylindrical, truncated bore;

said bore acting as a shoulder stop mating with said inner casing and further sandwiching said expansible chamber means between said inner casing circumferential edge and said shoulder stop to provide for said means for sealing said expansible chamber means;

at least one arcuate open portion extending along a diameter of said bore providing for said fluid passage means and having a width, length, and depth;

said width being less than one-half the diameter of said bore; said length being greater than the diameter of said bore but less than the diameter of said outer casing; and, said depth being greater than the depth of said bore but less than the depth of said cap.

4. The pen according to claim 2, wherein said expansible chamber means comprising a longitudinally expansible corrugated bellows.

5. The pen according to claim 1, wherein said expansible chamber means comprises a longitudinally expansible corrugated bellows.

6. The pen according to claim 1 wherein said fluid is a liquid.

7. The pen according to claim 6 wherein said liquid is water.

* * * * *